US005363526A

United States Patent [19]

Okajima

[11] Patent Number: 5,363,526

[45] Date of Patent: Nov. 15, 1994

[54] LAST FOR USE IN MAKING CYCLING SHOES, LAST AND CYCLING SHOE SOLE, AND A METHOD FOR MAKING SHOES USING A LAST

[75] Inventor: Shinpei Okajima, Izumi, Japan

[73] Assignee: Shimano Inc., Osaka, Japan

[21] Appl. No.: 751,953

[22] Filed: Aug. 29, 1991

[30] Foreign Application Priority Data

Sep. 7, 1990 [JP] Japan ..... 2-237763

[51] Int. Cl.[5] ..... A43B 3/00; A43B 5/00

[52] U.S. Cl. ..... 12/133 B; 36/131; 36/142

[58] Field of Search ..... 12/133 R, 133 B, 133 C, 12/140, 141, 142 P; 36/131

[56] References Cited

U.S. PATENT DOCUMENTS

| | | | |
|---|---|---|---|
| 645,038 | 3/1900 | Lyons | 12/141 |
| 1,482,201 | 1/1924 | Pym | 12/133 R X |
| 1,749,900 | 3/1930 | Bresnahan | 12/141 |
| 1,831,851 | 11/1931 | Everett | 36/127 |
| 1,868,225 | 7/1932 | Simon | 12/133 R |
| 2,044,676 | 6/1936 | Fikany | 12/133 R |
| 2,528,951 | 11/1950 | Epsztejn | 36/15 |
| 2,878,523 | 3/1959 | Hardy | 12/133 R |
| 3,144,669 | 8/1964 | Lamy | 12/141 |
| 3,186,113 | 6/1965 | Radcliffe et al. | 12/141 X |
| 3,302,313 | 2/1967 | Isaacson | 12/141 X |
| 3,552,041 | 1/1971 | Batchelder et al. | 36/43 |
| 3,987,510 | 10/1976 | Sbicca | 12/142 EV |
| 4,010,558 | 3/1977 | Slusher | 36/127 |
| 4,055,005 | 10/1977 | Meinhart | 36/135 |
| 4,222,182 | 9/1980 | Sears | 36/44 |
| 4,377,952 | 3/1983 | Gamondes | 36/131 |
| 4,506,463 | 3/1985 | Chassaing | 36/131 |
| 4,509,510 | 4/1985 | Hook | 128/252 |
| 4,570,363 | 2/1986 | Annovi | 36/117 |
| 4,596,163 | 6/1986 | Bon | 36/131 |
| 4,685,224 | 8/1987 | Anger | 36/43 |
| 4,783,911 | 11/1988 | Brown | 36/115 |
| 4,876,808 | 10/1989 | Hsieh | 36/136 |
| 4,893,420 | 1/1990 | Bezin et al. | 36/131 |
| 4,897,937 | 2/1990 | Misevich et al. | 36/43 |

FOREIGN PATENT DOCUMENTS

| | | | |
|---|---|---|---|
| 2405037 | 6/1979 | France . | |
| 3135345 | 3/1983 | Germany . | |
| 224624 | 11/1924 | United Kingdom . | |
| 401979 | 11/1933 | United Kingdom . | |
| 774742 | 5/1957 | United Kingdom . | |
| 1405718 | 4/1973 | United Kingdom . | |
| 2206030 | 12/1988 | United Kingdom . | |
| 2239780 | 7/1991 | United Kingdom | 36/131 |
| 8902625 | 3/1989 | WIPO | 74/594.6 |

*Primary Examiner*—Paul T. Sewell
*Assistant Examiner*—BethAnne C. Cicconi
*Attorney, Agent, or Firm*—Dickstein, Shapiro & Morin

[57] ABSTRACT

A last for use in making cycling shoes includes a sole supporting surface opposed to a shoe sole. The shoe sole defines a mounting bore for attaching a cleat or a shoe plate. The sole supporting surface includes position setting projections for engaging the mounting bore or the shoe sole to position the sole relative to the sole supporting surface.

18 Claims, 4 Drawing Sheets

LAST FOR USE IN MAKING CYCLING SHOES, LAST AND CYCLING SHOE SOLE, AND A METHOD FOR MAKING SHOES USING A LAST

BACKGROUND OF THE INVENTION

1. FIELD OF THE INVENTION

This invention relates to lasts for use in making cycling shoes, lasts and cycling shoe soles, and a method of making shoes using the last.

2. DESCRIPTION OF THE RELATED ART

A conventional last for use in making cycling shoes has a flat, sole supporting surface, and includes no device for setting the sole in position. In making a cycling shoe, a shoe sole is simply placed on the sole supporting surface, a quarter of the shoe is placed around the last, and the sole and quarter are joined.

With the above conventional last, however, the shoe sole placed on the sole supporting surface of the last would easily become displaced relative to this surface, making it difficult to join the sole and quarter of the shoe in an accurate positional relationship. Since the positional relationship between the foot that wears the shoe and a cleat mounting bore is determined mainly by the quarter of the shoe, the relationship between the foot and the cleat attached to the mounting bore becomes inappropriate, and hence a sufficient pedaling force cannot be transmitted from the cyclist's leg to a bicycle pedal. Even where the mounting bore allows positional adjustment of the cleat, only a narrow range of adjustment is available since the center of the mounting bore does not coincide with the center of the range of adjustment. Furthermore, certain parts of the shoe interior become larger and other parts smaller than design specifications. As a result, the foot is unduly squeezed to impair circulation of the blood or insufficiently braced by the shoe to create play inside, which could result in shoe sores and the like.

SUMMARY OF THE INVENTION

An object of the present invention is to provide a last for use in making cycling shoes, a last and cycling shoe sole, and a method of making shoes using the last, in which the sole and quarter of the shoe are joined in an accurate positional relationship.

The above object is fulfilled, according to the present invention, by a last for making cycling shoes, which includes a sole supporting surface opposed to a sole of a cycling shoe, and position setting projections formed on the sole supporting surface for engaging a mounting bore defined in the sole for attaching a cleat or a shoe plate, to set position of the sole relative to the sole supporting surface.

A method of manufacturing cycling shoes according to the present invention uses the above shoemaking last. This method includes the steps of placing the shoe sole on the sole supporting surface with the position setting projections engaging the mounting bore to set position of the sole relative to the sole supporting surface; placing a quarter of the shoe around the shoemaking last; and connecting the sole and the quarter.

In the last for making cycling shoes according to the present invention, the sole supporting surface includes position setting projections for engaging the mounting bore defined in the sole for attaching a cleat or a shoe plate, to set position of the sole relative to the sole supporting surface. With the position setting projections engaging the mounting bore, the shoe sole may be placed on the sole supporting surface in an appropriate positional relationship.

In the method of making cycling shoes according to the present invention, the shoe sole placed in position on the sole supporting surface as above is connected to the quarter of the shoe placed around the last. Consequently, the sole and quarter of the shoe are joined in an accurate positional relationship. This positional relationship is determined by the engagement between the position setting projections and the mounting bore for attaching a cleat or shoe plate. The positional relationship therefore is particularly accurate in the vicinity of the mounting bore.

Since the shoe sole and quarter are joined together in an accurate positional relationship according to the present invention, the cleat attached to the mounting bore and the foot wearing the shoe are in an appropriate positional relationship as designed, to transmit a sufficient pedaling force without loss from the cyclist's leg to a pedal. Where the mounting bore allows positional adjustment of the cleat, the center of the mounting bore coincides with the center of adjusting range to enable full use of the adjusting range. Moreover, since the shoe interior is formed to have dimensions as designed, the cyclist's foot is not excessively tightened while being held securely in the shoe, to prevent shoe sores.

Other objects, features and advantages of the present invention will be apparent from the following description of preferred embodiments.

BRIEF DESCRIPTION OF THE DRAWINGS

The drawings show a last for use in making cycling shoes, a last and cycling shoe sole, and a method of making shoes using a last according to the present invention, in which.

DETAILED DESCRIPTION OF THE PREFERRED EMBODIMENTS

An embodiment of the present invention will be described with reference to the drawings.

Figure 6:
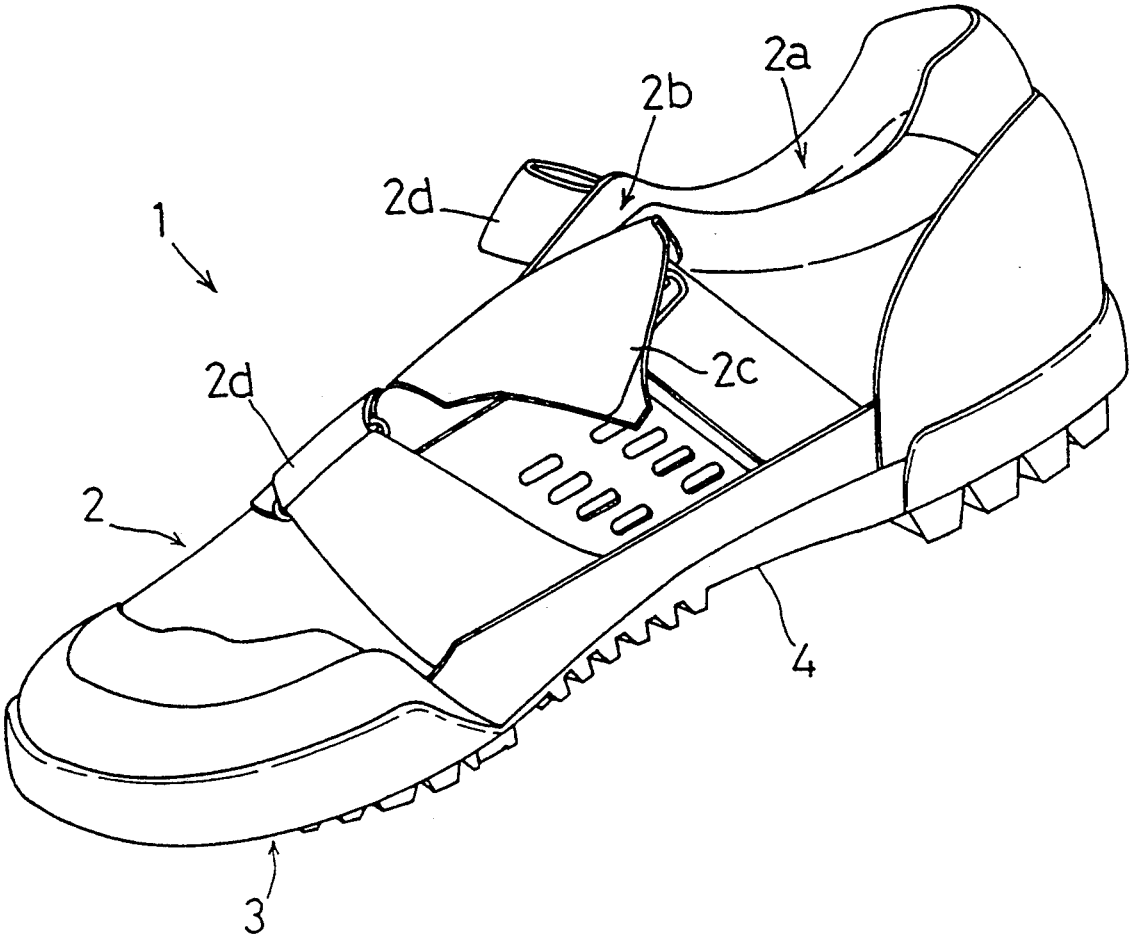
FIG. 6 is a perspective view of an entire shoe.

As shown in FIG. 6, a cycling shoe 1 includes a quarter 2 and a sole 3.

The quarter 2 includes an opening 2*a* for inserting a foot into the shoe 1, a cutout 2*b* disposed in an instep of the shoe 1 for enlarging the opening 2*a*, a flap 2*c* overlying the cutout 2*b* to prevent entry of sand or the like, and two straps 2*d* of the felt fastener type for pressing on the flap 2*c* from top tighten the instep of the foot.

Figure 3:
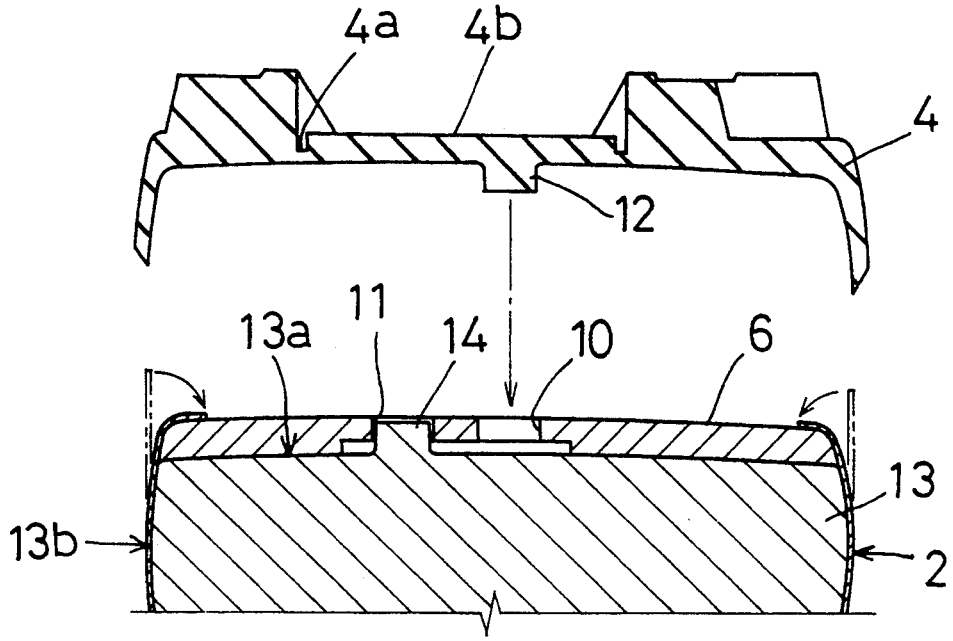
FIG. 3 is a view in vertical section showing a way in which an outsole is placed on the last.
Figure 4:
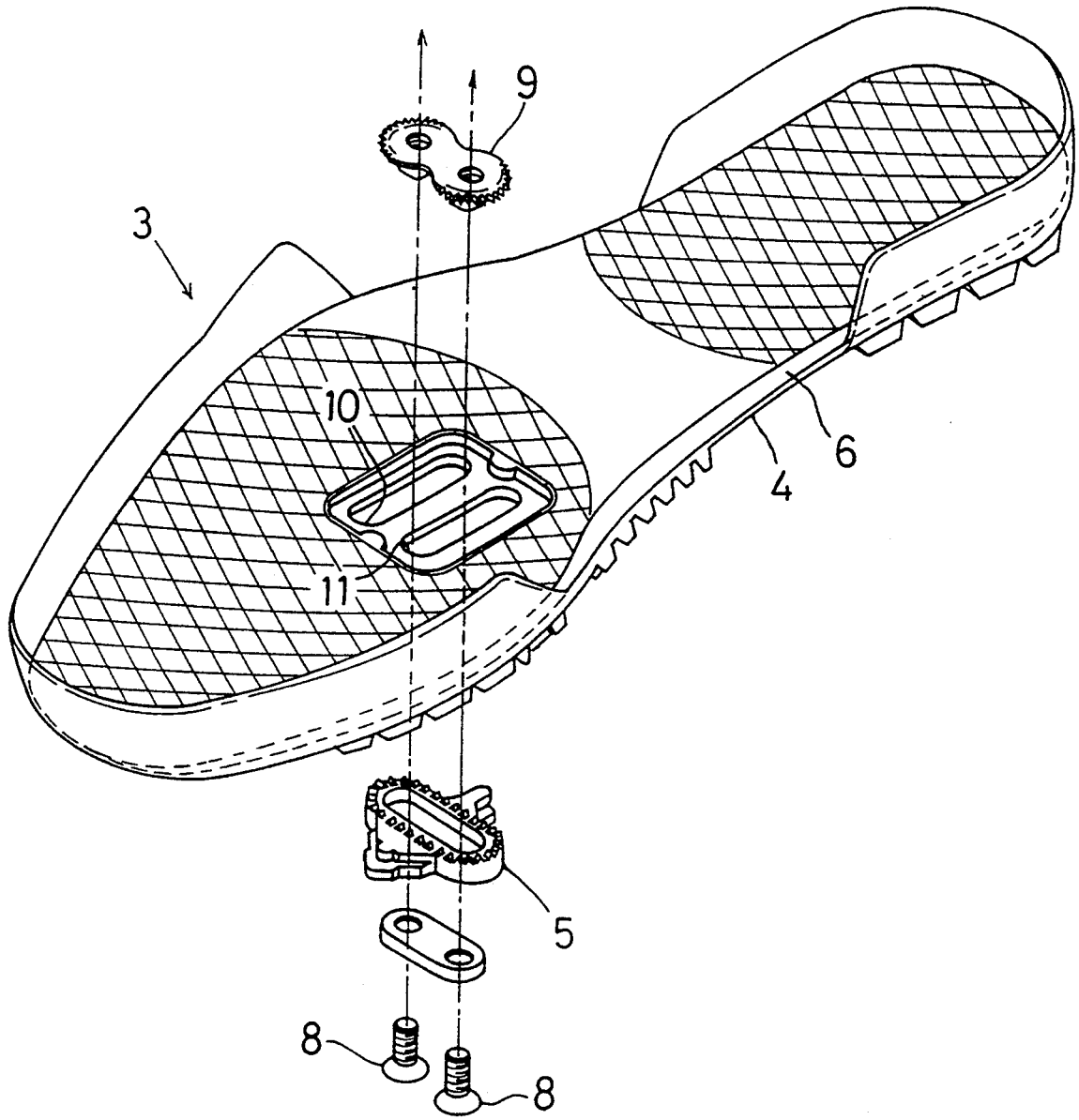
FIG. 4 is a an exploded perspective view showing a relationship between a cleat and the shoe sole.
Figure 5:
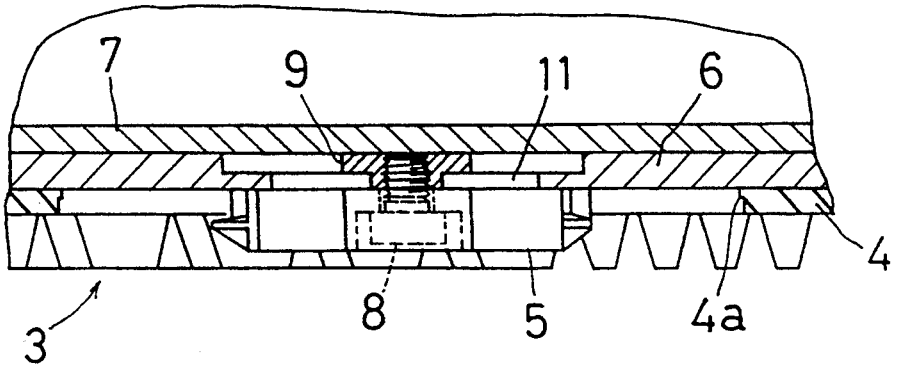
FIG. 5 is a view in vertical section showing the cleat mounted in position.

As shown in FIGS. 4 and 5, the sole 3 includes an outsole 4 formed of an elastic material such as rubber or an elastic resin, an insole 6 formed of a hard resin and bonded to an upper surface of the outsole 4 for attaching a cleat 5, and a platform 7 laid over an upper surface of the insole 6. The insole 6 defines first and second slots 10 and 11 in a region thereof opposed to and forwardly of the arch of the foot. These slots 10 and 11 extend substantially parallel each other longitudinally of the shoe 1, and are used to attach the cleat 5 with bolts 8 and nuts 9 as shown in FIG. 5. Further, as shown in FIG. 3, the outsole, 4 includes a groove 4*a* defined in a lower surface thereof and surrounding a tear-off portion 4*b* opposed to the slots 10 and 11. The tear-off portion 4*b* includes, in appropriate positions on an upper surface thereof, two outsole position setting projections 12 for engaging fore and aft ends of the first slot 10.

Figure 1:
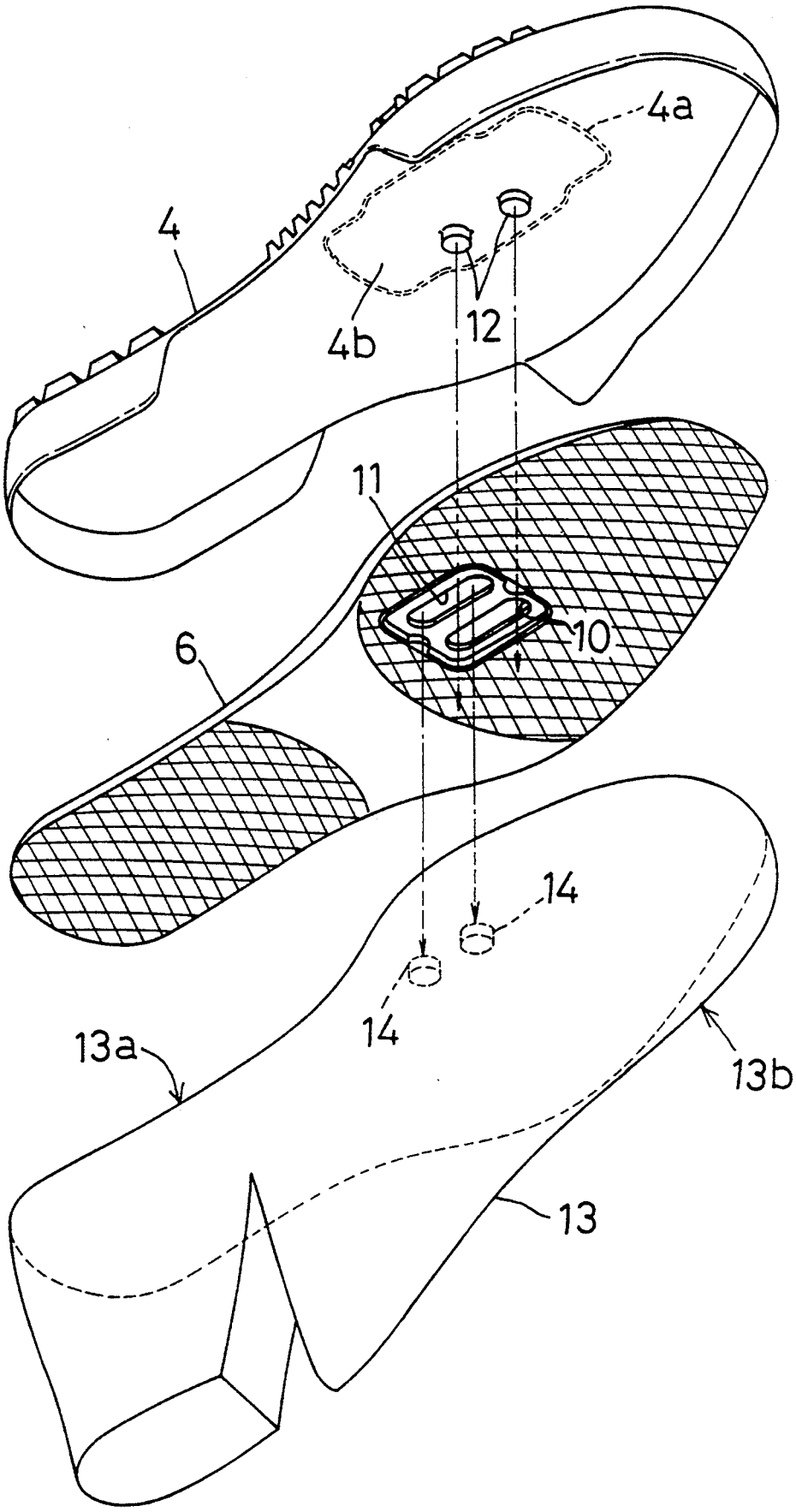
FIG. 1 is an exploded perspective view showing a relationship between a last and shoe sole.

As shown in FIG. 1, a last 13 for use in making cycling shoes according to the present invention includes a sole supporting surface 13*a* having a shape substantially corresponding to the insole 6, and a quarter supporting surface 13*b* for tight contact with inside surfaces of the quarter 2 of the shoe. The sole supporting surface 13*a* includes two insole position setting projections 14 for engaging fore and aft ends of the second slots 11. The two projections in each pair of the position setting projections 12 or 14 have peripheral walls facing away from each other shaped to correspond substantially to the opposite ends of the slot 10 or 11. The last 13 is formed of a resin such as nylon, and the position setting projections 14 may be formed integrally with or separately from the last A method of manufacturing the foregoing cycling shoe using the last 13 will be described next with reference to FIGS. 1 through 3.

(a) What is known as a hanging process is carried out with the quarter 2 of the shoe placed around and in tight contact with the quarter supporting surface 13*b* of the last 13.

Figure 2:
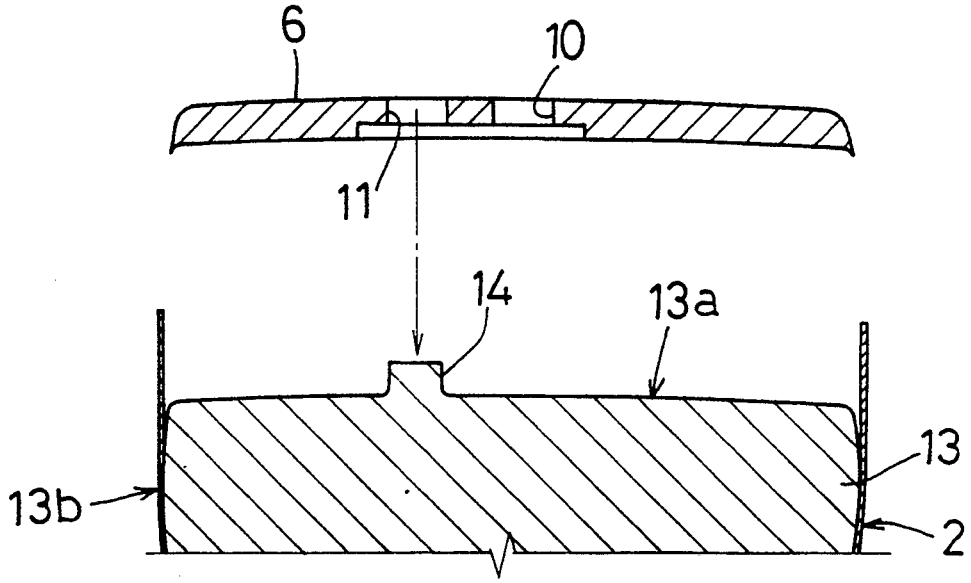
FIG. 2 is a view in vertical section showing a way in which an insole is placed on the last after a hanging process.

(b) As shown in FIG. 2, the insole 6 is placed in position on the sole supporting surface 13*a* with the position setting projections 14 fitted in the second slot 11.

(c) As shown in FIG. 3, the outsole 4 is placed in position on the insole 6, with ends of the quarter 2 folded over side edges of the insole 6 and position setting projections 12 fitted in the first slot 10. An adhesive is applied beforehand to the insole 6, outsole 4 and quarter 2 to bond these components together. However, the tear-off portion 4*b* and insole 6 are not allowed to bond together.

(d) The sole 3 is held tight by clamping dies while allowing the adhesive to cure.

(e) The platform is laid on the upper surface of the insole 6, and other accessories are attached to complete the shoe.

According to the above manufacturing method, the two outsole position setting projections 12 and two insole position setting projections 14 engage the fore and aft ends of the first and second slots 10 and 11, respectively. Consequently, the sole supporting surface 13*a* of the last 13, outsole 4 and insole 6 may be connected together in an accurate positional relationship not only in the longitudinal and transverse directions but with respect to crossing angles thereof.

For attaching the cleat 5 to the shoe sole 3 using the two slots 10 and 11, the tear-off portion 4*b* is cut along the groove 4*a*, and then the cleat is secured to the insole 6 with the bolts 8 and nuts 9 as shown in FIG. 5.

Other embodiments of the present invention are set out hereunder.

I. In the foregoing embodiment, the insole 6 is placed on the last 13 after the quarter 2 is placed around the last 13. Instead, the insole 6 may be placed on the last 13 before the quarter 2 is placed around the last 13. The insole 6 and outsole 4 may be bonded together before placement on the last 13.

II. In the foregoing embodiment, the insole 6 is formed of a hard material, and the slots 10 and 11 for attaching the cleat 5 are formed in the insole 6. It is possible to form the outsole 4 of a hard material and to form the slots 10 and 11 in the outsole 4. In this case, an insole formed of a soft material may be bonded to the upper surface of the outsole after the outsole and quarter 2 are connected together using the last 13 as in the foregoing embodiment.

III. In the foregoing embodiment, the two outsole position setting projections 12 and two insole position setting projections 14 are provided to engage the fore and aft ends of the first and second slots 10 and 11, respectively. It is possible to provide one projection to engage the entirety of each of the first and second slots 10 and 11.

IV. In the foregoing embodiment, the sole 3 and quarter 2 of the shoe are bonded together with an adhesive. However, these components may be stitched together.

V. The foregoing embodiment includes the slots for attaching the cleat 5. Round bores may be provided instead of the slots. Further, the two position setting projections 12 and two position setting projections 14 are provided to define non-circular parts substantially corresponding in shape to the mounting bores or slots 10 and 11 in plan view of the sole supporting surface 13*a* of the last 13. This assures an accurate positional relationship among the sole supporting surface 13*a*, outsole 4 and insole 6 with respect to crossing angles as well. Accurate crossing angles may be secured also by a crosswise arrangement in plan view of the position setting projections 12 and 14 and slots 10 and 11, for example.

VI. In the foregoing embodiment, the cleat 5 is attached to the sole 3. Alternatively, a shoe plate may be attached as in a road racer shoe.

VII. In the foregoing embodiment, the position setting projections 12 and 14 have a cylindrical shape. These projections may have a tapered shape diverging toward proximal ends thereof.

What is claimed is:

1. A combination comprising:

a cycling shoe comprising a cycling show sole and attaching means for attaching said sole to a cycle pedal, said sole comprising at least one mounting bore for attaching said attaching means to said sole; and a last for use in manufacturing said cycling shoe, comprising:

a sole supporting surface opposed to said cycling shoe, and position setting projections formed on said sole supporting surface for engaging said mounting bore to a set position of said sole relative to said sole supporting surface.

2. A combination as claimed in claim 1, wherein said position setting projections substantially corresponding to shape to said mounting bore.

3. A combination as claimed in claim 2, wherein said mounting bore is an elongated slot, and said position setting projections include at least two spaced apart projections, with peripheral surfaces of the projections substantially corresponding in shape to longitudinal opposite ends of said slot.

4. A combination as claimed in claim 3, wherein said sole includes an insole formed of a hard material and defining said mounting bore and a further mounting bore, and an outsole attached to said insole, said outsole including further position setting projections formed on an upper surface thereof for engaging said further mounting bore to position said outsole relative to said insole, and tear-off means for facilitating removal of a portion of said outsole opposed to said mounting bore and said further mounting bore.

5. A method of manufacturing a cycling shoe comprising the steps of:

providing a last comprising a sole supporting surface and position setting projections formed on said sole supporting surface, providing a shoe sole having mounting bores for connecting an attaching means to said sole, said attaching means being arranged for attaching said cycling shoe to a pedal of a bicycle, placing said shoe sole on said sole supporting surface with said position setting projections engaging one of said mounting bores to set a position of said sole relative to said sole supporting surface, placing a quarter of the shoe around said shoemaking last, and connecting said sole and said quarter.

6. A combination as claimed in claim 1, wherein said sole includes an insole, said mounting bore being located in said insole, said sole further including an outsole for connecting said pedal, and wherein the height of said position setting projection is smaller than the thickness of said insole.

7. A combination as claimed in claim 6, wherein said position setting projections are integrally formed with said sole supporting surface.

8. A combination as claimed in claim 7, wherein said at least one mounting bore includes a first elongate bore and a second elongate bore, said bores being parallel to each other, and wherein said position setting projections are spaced apart to contact corresponding edges of said first elongate bore.

9. A combination as claimed in claim 8, wherein contact portions of said position setting projections are shaped in conformity with said corresponding edges of said first elongate bore.

10. A combination as claimed in claim 8, wherein a surface of said outsole facing said insole has outsole positioning projections for positioning said outsole with respect to said insole by insertion of said outsole positioning projections into said second elongate bore.

11. A combination as claimed in claim 10, wherein a removable portion is provided in a region of said outsole facing said first and second elongate bores.

12. A combination as claimed in claim 1, wherein cross sections of said position setting projections in a plane substantially parallel to said sole supporting surface are substantially circular.

13. A combination of claimed in claim 1, wherein said position setting projections have tapered shapes.

14. A combination as claimed in claim 14, wherein said position setting projections are formed separately from said sole supporting surface.

15. A combination as claimed in claim 1, wherein said attaching means is a cleat.

16. A combination as claimed in claim 1, wherein said attaching means is a shoe plate.

17. A combination for use in making a cycling shoe, comprising:

a cycling shoe sole having first and second elongate bores defined in said sole for attaching an attaching means to said sole; and a last comprising:

a sole supporting surface opposed to said cycling shoe, and a position setting projection formed on said sole supporting surface for engaging said first elongate bore, the shape of said position setting projection being in conformity with the shape of said first elongate bore.

18. A method of manufacturing a cycling shoe, comprising:

providing an insole having first and second elongated mounting bores for attaching said shoe to a bicycle pedal;

providing an outsole having outsole positioning projections for positioning said outsole with respect to said insole by engagement between said outsole positioning projections and said second mounting bore;

providing a last including a sole supporting surface and position setting projections for positioning said insole with respect to said sole supporting surface by engagement between said position setting projections and said first mounting bore;

placing said insole on said sole supporting surface with said position setting projections engaging said first mounting bore to set a position of said insole relative to said sole supporting surface;

placing a quarter of the shoe around said last;

connecting said insole and said quarter; and placing said outsole on said insole with said outsole positioning projections engaging said second mounting bore to set position of said outsole relative to said insole.

* * * * *